United States Patent [19]

Steinberger

[11] Patent Number: 4,878,413

[45] **Date of Patent: * Nov. 7, 1989**

[54] STRING TUNING AND CLAMPING DEVICE

[75] Inventor: Ned Steinberger, Cornwall, N.Y.

[73] Assignee: Steinberger Sound Corporation, Newburgh, N.Y.

[ * ] Notice: The portion of the term of this patent subsequent to Sep. 1, 2004 has been disclaimed.

[21] Appl. No.: 59,624

[22] Filed: Jun. 8, 1987

[51] Int. Cl.[4] ..... G10D 3/12

[52] U.S. Cl. ..... 84/314 N; 84/312 R

[58] Field of Search ..... 84/267, 312 R, 314 N

[56] References Cited

U.S. PATENT DOCUMENTS

| | | | |
|---|---|---|---|
| 1,546,804 | 7/1925 | Stover | 84/304 |
| 4,549,460 | 10/1985 | Gressett et al. | 84/298 |
| 4,579,033 | 4/1986 | Edwards | 84/313 N |
| 4,667,561 | 5/1987 | Storey et al. | 84/314 N |
| 4,690,028 | 9/1987 | Steinberger | 84/314 N |
| 4,712,463 | 12/1987 | Kubicki et al. | 84/304 |

FOREIGN PATENT DOCUMENTS

| | | | |
|---|---|---|---|
| 162542 | 3/1949 | Austria | 84/312 R |
| 2826837 | 1/1979 | Fed. Rep. of Germany | 84/312 R |
| 2479522 | 10/1981 | France | 84/208 |

*Primary Examiner*—Lawrence R. Franklin

*Attorney, Agent, or Firm*—Finnegan, Henderson, Farabow, Garrett & Dunner

[57] ABSTRACT

A device for clamping and tuning strings which extend longitudinally between and past the nut and bridge of a musical instrument includes a base. The base includes a plurality of threaded shank elements. A plurality of threaded nuts are each threaded on a respective shank element. A plurality of actuators are each threaded on a respective threaded shank proximate to a respective threaded nut for selectively applying clamping pressure to a string position between a respective actuation means and threaded nut by rotating relative to a respective threaded nut and shank element. A plurality of cams are provided, each rotatably mounted on the base proximate to one of the strings at a position past the portion of the string between the nut and bridge for moving longitudinally relative to the extent of the string while displacing the string in a direction generally lateral to the longitudinal extent of the string when the cam is rotated for adjusting the pitch of the string by adjusting the tension of the string.

14 Claims, 4 Drawing Sheets

STRING TUNING AND CLAMPING DEVICE

BACKGROUND OF THE INVENTION

The invention relates to tuning and clamping devices for tuning and clamping the strings of a musical instrument.

Clamping devices have been used to clamp the strings of a musical instrument in order to anchor the ends of the strings and to prevent sliding movement of the strings over the nut and the bridge of the instrument particularly when a tremolo mechanism is used.

Known string clamping devices have a variety of shortcomings. Some are complex mechanisms which are expensive to manufacture. Others are difficult to use or require tools to be used. Still others do not permit adequate individual adjustment, control and accommodation of each string.

Similarly, tuning devices have been used to adjust the pitch of the strings of a musical instrument by adjusting the tension of the strings.

Known tuning devices have a variety of shortcomings. Some are complex mechanisms which are expensive to manufacture. Others are difficult to use, take up excessive space, or are inconveniently positioned for adjustment during play. Still others do not permit adequate fineness of adjustment, control, and accommodation of each string.

Accordingly, it is an object of this invention to provide a clamping device which is a simple mechanism and inexpensive to manufacture.

It is another object of this invention to provide a clamping device which is easy to use and which can be operated without tools.

It is a further object of this invention to provide a clamping device which clamps each string of the stringed instrument individually to allow individual adjustment, control and accommodation of each string.

It is also an object of this invention to provide a tuning device which is a simple mechanism and inexpensive to manufacture.

It is another object of this invention to provide a tuning device which is easy to use, economical in terms of space and easily accessible for adjustment during play.

It is still a further object of this invention to provide a tuning device which allows each string of a stringed instrument to be tuned individually with sufficient fineness and reliability to allow sufficiently adequate individual adjustment, control and accommodation of each string.

It is an additional object of the present invention to provide a string tuning and clamping device which is compact as a unit, and easy to manufacture and use.

Additional objects and advantages of the invention will be set forth in the description which follows and, in part, will be obvious from the description, or may be learned by practice of the invention. The objects and advantages of the invention may be realized and obtained by means of the instrumentalities and combinations particularly pointed out in the claims.

SUMMARY OF THE INVENTION

To achieve the foregoing objects and in accordance with the purposes of the invention as embodied and broadly described herein, there is provided a device for clamping and tuning strings which extend longitudinally between and past the nut and bridge of a musical instrument comprising: a base, the base including a plurality of threaded shank elements; a plurality of threaded nuts, each threaded on a respective shank element; and a plurality of actuation means, each threaded on a respective threaded shank proximate to a respective threaded nut for selectively applying clamping pressure to a string positioned between a respective actuation means and threaded nut by rotating relative to a respective threaded nut and shank element; and a plurality of cam means, each rotatably mounted on the base proximate to one of the strings at a position past the portion of the string between the nut and bridge for moving longitudinally relative to the extent of string while displacing the string in a direction generally lateral to the longitudinal extent of the string when the cam means is rotated for adjusting the pitch of the string by adjusting the tension of the string.

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided a device for clamping and tuning strings extending longitudinally between and past the nut ad bridge of a musical instrument comprising a base, the base including a plurality of threaded shank elements; a plurality of threaded nuts, each threaded on a respective shank element; a plurality of actuation means, each threaded on a respective threaded shank proximate to a respective threaded nut for selectively applying clamping pressure to a string positioned between a respective actuation means and threaded nut by rotating relative to a respective threaded nut and shank element; and a plurality of cam means, each rotatably mounted on the base proximate to one of the strings at a position past the portion of the string between the nut and bridge for moving longitudinally relative to the extent of string while displacing the string in a direction generally lateral to the longitudinal extent of the string when the cam means is rotated for adjusting the pitch of the string by adjusting the tension of the string.

Figure 5:
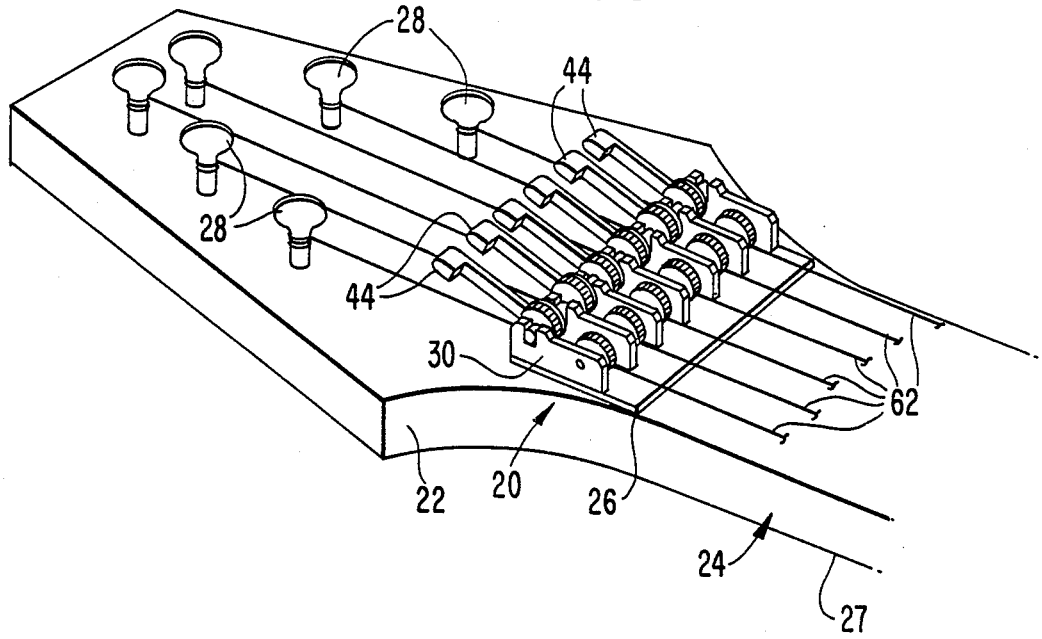
FIG. 5 is a perspective view of the embodiment shown in FIG. 1 mounted on the head stock of a stringed instrument.

A device for clamping and tuning strings of a musical instrument is generally shown in FIG. 5 as clamping and tuning device 20. Clamping and tuning device 20 is mounted on the head stock 22 of a stringed musical instrument 24 between the nut 26 of the instrument and conventional tuners 28 mounted on head stock 22. Clamping and tuning device 20 may also be used without a conventional tuner and may also be positioned on the tail stock of a stringed musical instrument past the position of the bridge.

Figure 9:
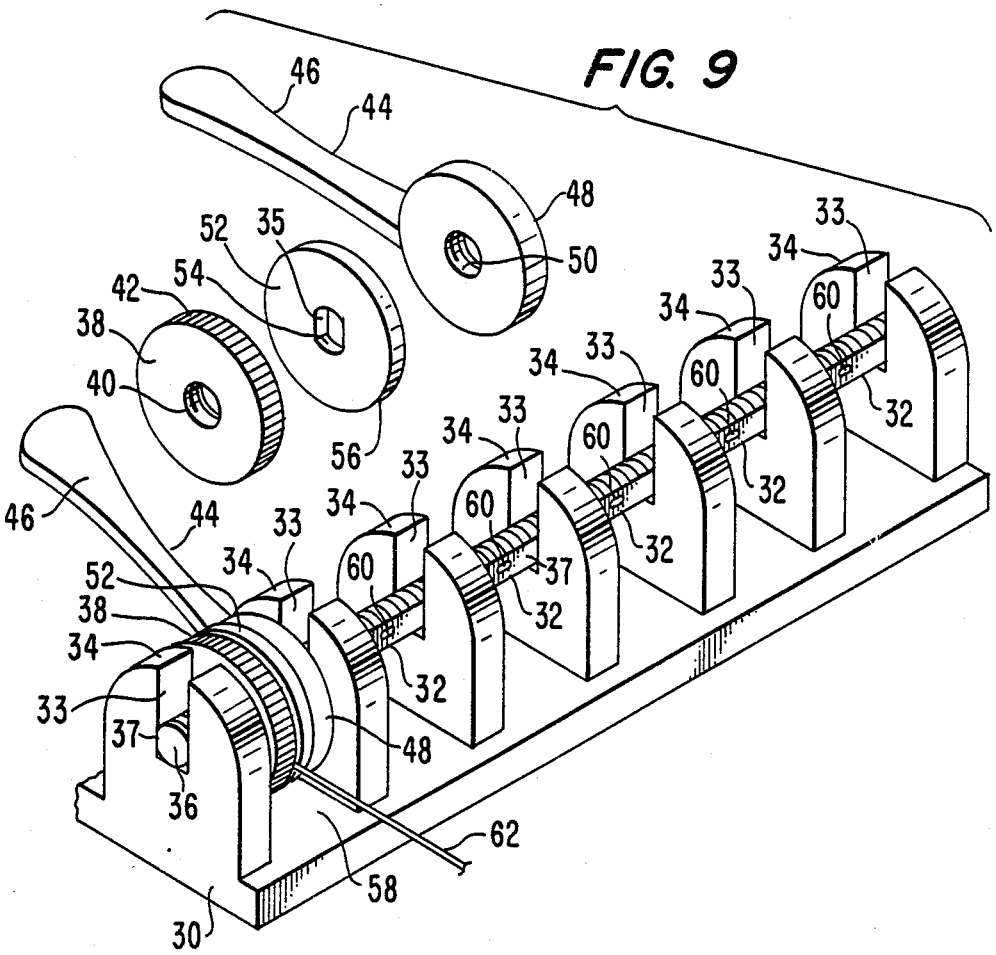
FIG. 9 is a partially exploded perspective view of a portion of the embodiment shown in FIG. 1.
Figure 10:
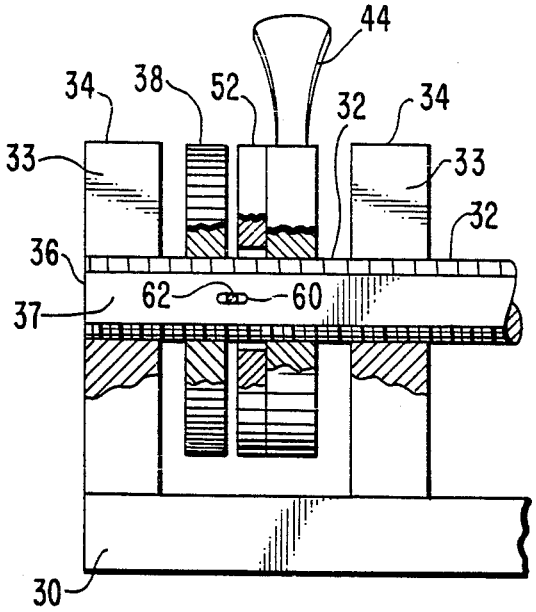
FIG. 10 is a partial side cross section view of the embodiment shown in FIG. 9.

According to the present invention, the clamping and tuning device includes a base, the base including a plurality of threaded shank elements. As shown in FIGS. 9 and 10, the base includes base 30 including a plurality of threaded shank elements 32. Base 30 may be formed by cutting a series of slots from a block of metal to form a series of spaced plates 34, cutting slots 33 in those plates 34 and inserting a threaded shank 36 which has been machined flat on two sides 37 into slots 33. Threaded shank elements 32 are constituted by portions of threaded shank 36 which are positioned between plates 34. As will be evident, it is also possible to construct clamping and tuning device 20 without the use of plates 34.

According to the present invention, there is provided a plurality of threaded nuts, each threaded on a respective shank element. As shown in FIGS. 9 and 10, the threaded nuts include threaded nuts 38 which are each threaded on a respective shank element 32. Threaded nuts 38 include a threaded tapped portion 40 which is complementary to the threaded shank elements 32. The outer circumferential surface 42 of each threaded nut 38 is preferably serrated or knurled to allow it to be easily engaged and rotated by an operator's finger.

In accordance with the present invention there is provided a plurality of actuation means, each threaded on a respective threaded shank proximate to a respective threaded nut for selectively applying clamping pressure to a string position between a respective actuation means and threaded nut by rotating relative to a respective threaded nut and shank element.

As shown in FIGS. 9 and 10, the plurality of actuation means include actuators 44 which include a lever portion 46 and an annular portion 48 having a threaded tapped portion 50 which is complementary to the threaded shank elements 32.

It is preferable to provide a plurality of two-sided movable clamping plates, one side of each plate being in opposed relation to a respective threaded nut, each movable clamping plate freely slidable relative to the threaded shank elements and wherein each actuation means is threaded on a respective threaded shank element proximate to the other side of a respective movable clamping plate for selectively applying clamping pressure to a respective movable clamping plate by rotating relative to a respective threaded nut, shank element and movable clamping plate for clamping a string between the respective movable clamping plate and threaded nut.

As shown in FIGS. 9 and 10, the plurality of two-sided movable clamping plates include clamping plates 52. Each movable clamping plate 52 is freely slidable relative to the respective threaded shank element 32. Movable clamping plates 52 include an aperture 54 which is larger than the outside diameter of the threaded shank elements 32. Movable clamping plates 52 also include means for preventing the rotation relative to base 30 such as flat surface 35 which is complementary to flat surface 37 on each threaded shank element 32.

It is preferable that each threaded nut includes a circumferentially running thumb wheel portion means for facilitating rotation. As shown in FIGS. 9 and 10, the thumb wheel portion means includes outer circumferential surface 42 which is serrated or knurled.

It is preferable that the actuation means includes a lever portion. As shown in FIG. 9, actuation means 44 includes lever portion 46.

Figure 3:
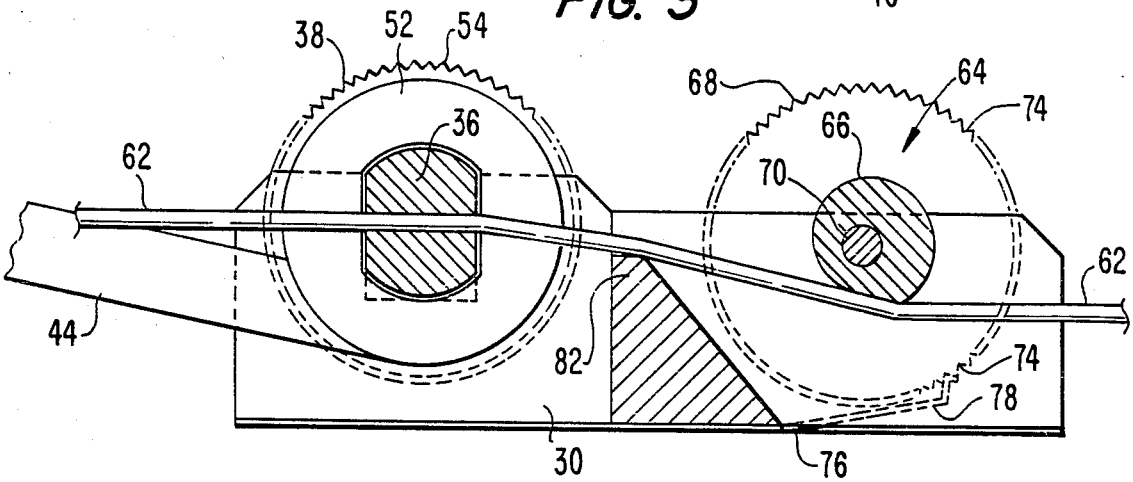
FIG. 3 is an enlarged side view in cross section of the embodiment shown in FIG. 1.

It is preferable that the movable clamping plate includes means for preventing rotation of the movable clamping plate relative to the base. As shown in FIG. 9, the means for preventing rotation includes a keyed slot formed by aperture 54 in movable clamping plate 54 and complementary shaped threaded shank 36 as shown in FIG. 3.

An alternative means for preventing rotation of the movable clamping plate relative to the base includes a flat surface (not shown) on the circumference 56 of clamping plate 52 which is complementary to flat surface 58 of base 30.

It is preferable that the clamping and tuning device includes stops, that the threaded shank elements extend between the stops, and that the threaded nut, actuation means and movable clamping plate are interposed between the stops. As shown in FIG. 9, the stops include spaced plates 34 which are fixed to base 30 or integral with base 30 and which receive threaded shank 36.

It is preferable to provide aperture means through each threaded shank element for confining a string. As shown in FIGS. 9 and 10, the aperture means for confining a string includes aperture 60 in threaded shank element 32 through which respective strings 62 extend. Aperture 60 allows clamping pressure to be evenly distributed without twisting of nut 38 or actuator 44.

It is preferable that the plurality of threaded shank elements constitute portions of a single threaded shank. As shown in FIGS. 9 and 10, the plurality of threaded shank elements 32 constitute portions of a single threaded shank 36.

In one alternative, it is preferable that the base includes an integral string nut for the musical instrument. As shown in FIG. 5, the base 30 includes an integral string nut 26 for the musical instrument.

According to the present invention there is provided a plurality of cam means, each rotatably mounted on the base proximate to one of the strings at a position past the portion of the string between the nut and bridge for moving longitudinally relative to the extent of the string while displacing the string in a direction generally lateral to the longitudinal extent of the string when the cam means is rotated for adjusting the pitch of the string by adjusting the tension of the string. It is preferable that each cam means include a rotatable disk having an axis of rotation extending in a direction generally across the longitudinal extent of the strings.

It is further preferable that each cam means includes a circumferentially running radially varying cam portion means for displacing a string and a circumferentially running thumb wheel portion means for actuating the cam means.

Figure 1:
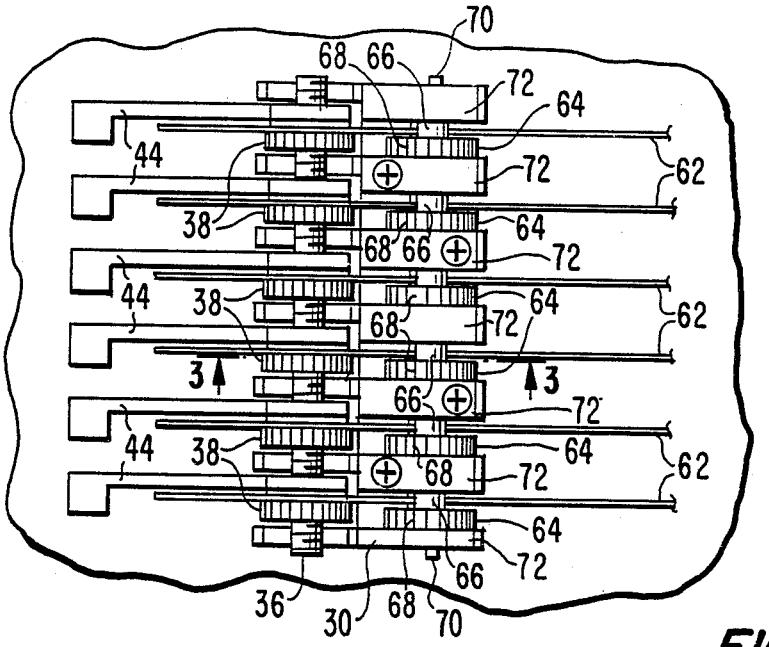
FIG. 1 is a top view of a first embodiment of a tuning and clamping device for the strings of a musical instrument incorporating the teachings of the present invention.
Figure 2:
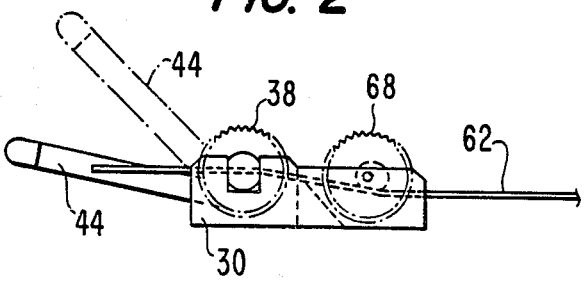
FIG. 2 is a side view of the embodiment shown in FIG. 1.

As shown in FIGS. 1–3, each cam means includes a rotatable disc such as rotatable discs 64, each having an axis of rotation extending in a direction generally across the longitudinal extent of the strings, as best shown in FIG. 1.

As shown in FIG. 3, the circumferentially running radially varying cam portion means includes cam portion 66. The circumferentially running thumb wheel portion means for actuating the cam means includes thumb wheel portion 68. Cam portion 66 and thumb wheel portion 68 are integral with each other so that cam portion 66 rotates as thumb wheel portion 68 is rotated by an operator.

It is preferable that a single shaft extends along the axis of rotation of all of the rotatable discs and forms an axle for all of the discs. As shown in FIGS. 1–3, the single shaft forming an axle includes axle 70.

It is preferable that lateral guide means are provided for maintaining each string in a position relative to the cam portion means. It is further preferable that the guide means includes a portion of the base means and the circumferentially running thumb wheel portion means attached to the cam portion means for actuating the cam means.

As shown in FIG. 1, the lateral guide means includes a portion of the base means, namely, plates 72 and thumb wheel portion 68.

It is preferable to provide detent means for securing each cam means in a selected position. It is preferable that the detent means include serrations in the surface of each cam means, most preferably in the circumferentially running thumb wheel portion means, and a spring-actuated ratchet which engages the serrations.

Figure 4:
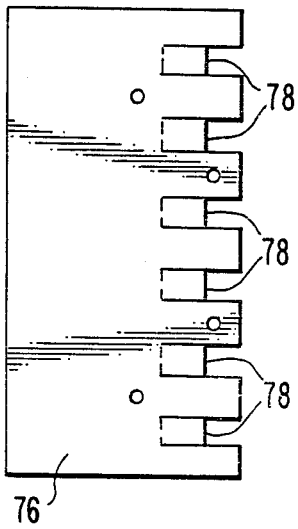
FIG. 4 is a partial bottom view of the embodiment shown in FIG. 1.

As shown in FIG. 3, the detent means includes serrations 74 in the surface of thumb wheel portion 68 and a spring-actuated ratchet 76 which engages serrations 74. The spring-actuated ratchet 76 is positioned on the bottom of base 30 and is shown in detail in FIG. 4 from below and in FIG. 3 from the side as having extending fingers 78 of spring steel which engage serrations 74.

Figure 6:
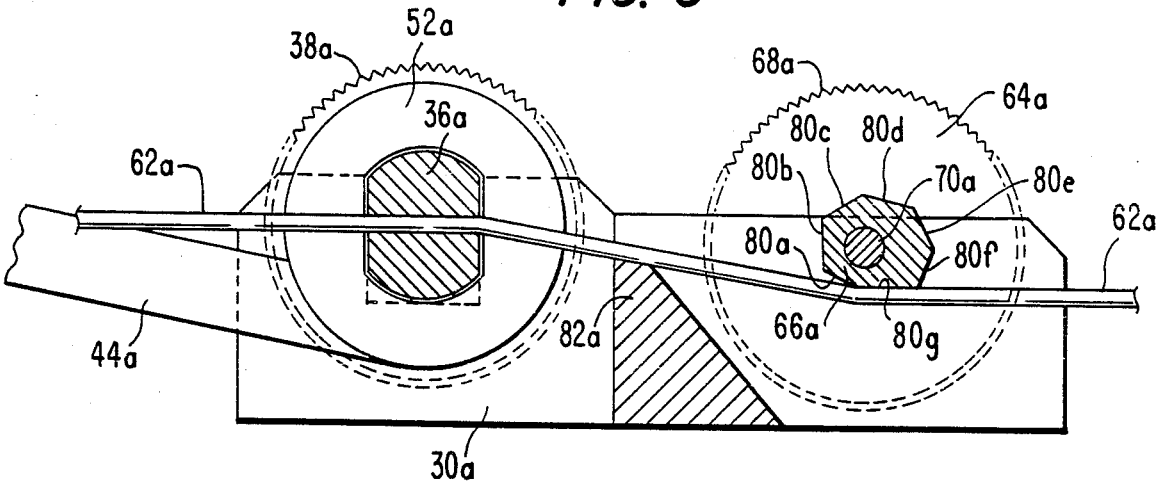
FIG. 6 is a side view in cross section of a second embodiment of a tuning and clamping device for strings of a musical instrument incorporating the teachings of the present invention.

Alternately, it is preferable that the detent means includes a series of flat surfaces on a circumferentially running radially varying cam portion means on the cam means for laterally displacing a string and for maintaining a position complementary to a respective string. As shown in FIG. 6, the detent means includes a series of flat surfaces such as flat surfaces **80*a*–80*g* on cam portion 66*a* of rotatable disc 64*a***.

It is further preferable to provide plate means between the shank elements and the cam means for engaging the strings. As shown in FIG. 3, the plate means includes plate 82 which engages the strings 62.

Alternatively, it is preferred that the clamping and tuning device include a plurality of tuning screws threaded into the base at a position past the portion of the string between the nut and bridge, each tuning screw having a proximal portion for manual engagement and a distal portion for displacing a respective string in a direction generally lateral to the longitudinal extent of the string when the tuning screw is rotated for adjusting the pitch of the string by adjusting the tension of the string. It is further preferable that slot means are provided in the base for confining lateral movement of the strings in the proximity of the tuning pegs.

Figure 7:
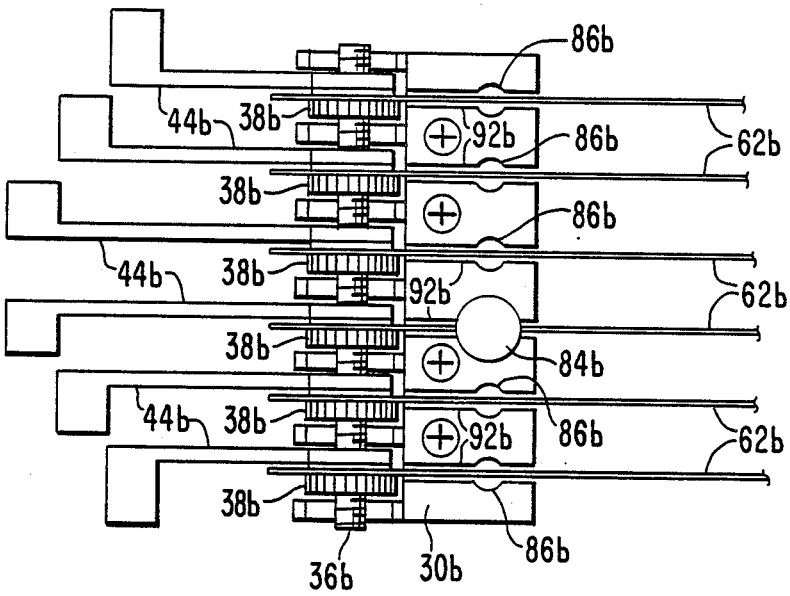
FIG. 7 is a top view of a third embodiment of a tuning and clamping device for the strings of a musical instrument incorporating the teachings of the present invention.
Figure 8:
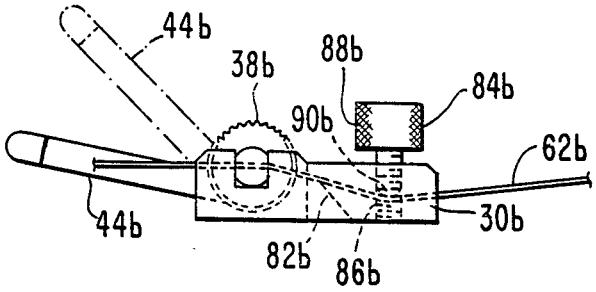
FIG. 8 is a side view of the embodiment shown in FIG. 7.

As shown in FIGS. 7 and 8, the plurality of tuning screws include tuning screws **84*b* threaded into base 30*b* through tapped threaded holes 86*b*. The proximal portion of each tuning screw 84*b* includes a knurled head 88*b* for manual engagement and rotation. The distal portion includes distal tip 90*b* which engages string 62*b* and displaces that string in a direction generally lateral to the longitudinal extent of the string when the tuning screw is rotated. Slot means include longitudinally running slots 92*b* in base 30*b* for confining lateral movement of strings 62*b* in the proximity of tuning screws 84*b***.

The operation of the preferred embodiment of the clamping portion of clamping and tuning device 20 can be best understood from FIGS. 9 and 10. String 62 is placed through aperture 60 of threaded shank 36 between threaded nut 38 and movable clamping plate 52. Threaded nut 38 is rotated with a tip of a finger through use of serrated or knurled surface 42 until string 62 is spaced from the side of aperture 60. Lever portion 46 of actuator 44 is then rotated by hand, pushing movable clamping plate 52 against string 62 and clamping it between movable clamping plate 52 and nut 38. If actuator 44 cannot be sufficiently tightened in such position, it is then loosened and nut 38 is advanced for appropriate clamping action of actuator 44. This arrangement allows the clamping device to be adjusted to accommodate strings of various thicknesses.

Movable clamping plate 52 moves along threaded shank 36 but does not rotate relative to threaded shank 36, thereby preventing string 62 from twisting when actuator 44 is tightened. Although the clamping device may be operated without the use of a movable clamping plate 52, it is highly preferable that a movable plate 52 is used during operation.

After actuators 44 have been used to clamp strings 62, it may be necessary to further tune strings 62. As shown in FIG. 3, rotatable disc 64 is then rotated in a counterclockwise position, based on the orientation shown in FIG. 3 and cam portion 66 slides along the surface of string 62 while laterally displacing string 62 and thereby stretching and tuning string 62. Spring-actuated ratchet 76 catches in serration 74 to prevent rotatable disc 64 from slipping backward.

In the embodiment shown in FIG. 6, flat surfaces **80*a–g* of cam portion 66 successively engage strings 62*a*, laterally deflecting string 62*a* for tensioning and tuning string 62*a***.

In the embodiment shown in FIG. 8, the strings are tuned by rotating tuning screws **84*b* to laterally deflect strings 62*b*** and thereby tension and tune the strings.

As shown in FIG. 3, plate 82 and corresponding structure in other embodiments permits the strings to properly ride along on the tuning mechanism such as cam portion 66.

FIG. 5 shows the clamping position of clamp and tuning device 20 wherein one actuator lever is in an open position pointing down the neck 27 of a guitar, and the remaining actuator levers 44 are in a closed position pointing away from neck 27 and toward head stock 22 of the guitar. Therefore, as shown in FIG. 5, the clamping motion of the actuator levers 44 occurs in a counterclockwise position and the unclamping motion occurs in a clockwise direction.

The system is preferably constructed so that actuator levers 44 can be rotated as little as 90° to effect good clamping pressure, while nuts 38 can be rotated through 360° to accommodate any variation in string diameter. The actuator lever 44 is long enough to provide mechanical advantage for sufficient clamping pressure and is only required for the final quarter rotation.

When string clamp 20 is mounted on the head stock of a guitar, actuators 40 are placed in an open position. Then the string is tuned to the proper pitch by using conventional tuning pegs 28 on the head stock 22 of the guitar. Finally, the string is locked into place on the string clamp 20 by actuator levers 44.

A string clamping device according to the present invention may be mounted on the moving part of a tremolo device on a guitar. In addition, it may be mounted on string instruments other than guitars, such as violins and banjos.

Additional advantages and modifications will readily occur to those skilled in the art. The invention in its broader aspects is, therefore, not limited to the specific details, representative apparatus and illustrative examples shown and described. Accordingly, the departures may be made from such details without departing from the spirit or scope of the applicant's invention.

What is claimed is:

1. A device for clamping and tuning strings which extend longitudinally between and past the nut and bridge of a musical instrument comprising:

a base;

clamping means mounted on the base for clamping the strings at a position past the portion of the string between the nut and bridge; and a plurality of cam means, each rotatably mounted on the base proximate to one of the strings at a position past the portion of the string between the nut and bridge and between the clamping means and one of the nut and bridge, for moving longitudinally relative to the extent of the string while displacing the string in a direction generally lateral to the longitudinal extent of the string when the cam means is rotated for adjusting the pitch of the string by adjusting the tension of the string.

2. A device for clamping and tuning strings which extend longitudinally between and past the nut and bridge of a musical instrument comprising:

a base, the base including a plurality of threaded shank elements;

a plurality of threaded nuts, each threaded on a respective shank element; and a plurality of actuation means, each threaded on a respective threaded shank proximate to a respective threaded nut for selectively applying clamping pressure to a string positioned between a respective actuation means and threaded nut by rotating relative to a respective threaded nut and shank element; and a plurality of tuning screws threaded into the base at a position past the portion of the string between the nut and bridge, each tuning screw having a proximal portion for manual engagement and distal portion for displacing a respective string in a direction generally lateral to the longitudinal extent of the string when the tuning screw is rotated for adjusting the pitch of the string by adjusting the tension of the string.

3. The device of claim 2 including a plate means between the shank elements and the tuning screws for engaging the strings.

4. The device of claim 2 wherein the base includes slot means for confining lateral movement of the strings in the proximity of the tuning screws.

5. A device for clamping and tuning strings which extend longitudinally between and past the nut and bridge of a musical instrument comprising:

a base, the base including a plurality of threaded shank elements;

a plurality of threaded nuts, each threaded on a respective shank element; and a plurality of actuation means, each threaded on a respective threaded shank proximate to a respective threaded nut for selectively applying clamping pressure to a string positioned between a respective actuation means and threaded nut by rotating relative to a respective threaded nut and shank element; and a plurality of cam means, each rotatably mounted on the base proximate to one of the strings at a position past the portion of the string between the nut and bridge for moving longitudinally relative to the extent of the string while displacing the string in a direction generally lateral to the longitudinal extent of the string when the cam means is rotated for adjusting the pitch of the string by adjusting the tension of the string.

6. The device of claim 5 including a plate means between the shank elements and the cam means for engaging the strings.

7. A clamping device for the strings of a musical instrument comprising:

a base, the base including a plurality of threaded shank elements, each threaded shank element including aperture means therethrough for confining a string;

a plurality of threaded nuts, each threaded on a respective shank element;

a plurality of two-sided movable clamping plates, one side of each plate being in opposed relation to a respective threaded nut, each movable clamping plate freely slidable relative to the threaded shank elements; and a plurality of actuation means, each threaded on a respective threaded shank element proximate to the other side of a respective movable clamping plate for selectively applying clamping pressure to a respective movable clamping plate by rotating relative to a respective threaded nut shank element and movable clamping plate, for clamping a string between a respective movable clamping plate and threaded nut.

8. The clamping device of claim 7 wherein the movable clamping plate includes means for preventing rotation of the movable clamping plate relative to the base.

9. The clamping device of claim 7 including stops, and wherein the threaded shank elements extend between the stops, and wherein the threaded nut, actuation means and movable clamping plate on each threaded shank are interposed between a pair of stops.

10. A clamping device for the strings of a musical instrument comprising:

a base, the base including a plurality of threaded shank elements, each threaded shank element including aperture means therethrough for confining a string;

a plurality of threaded nuts, each threaded on a respective shank element; and a plurality of actuation means, each threaded on a respective threaded shank proximate to a respective threaded nut for selectively applying clamping pressure to a string positioned between a respective actuation means and threaded nut by rotating relative to a respective threaded nut and shank element.

11. The clamping device of claim 10 wherein each threaded nut includes a circumferentially running thumb wheel portion means for facilitating rotation.

12. The clamping device of claim 10 wherein the actuation means includes a lever portion.

13. The clamping device of claim 10 wherein the plurality of threaded shank elements constitute a single threaded shank.

14. The clamping device of claim 10 wherein the base includes an integral string nut for the musical instrument.

* * * * *